United States Patent [19]

Koloczek et al.

[11] 4,229,721

[45] Oct. 21, 1980

[54] WELDING TRANSFORMER WITH DROOPING VOLTAGE-CURRENT CHARACTERISTICS

[75] Inventors: Wiktor Koloczek; Edward Dobaj; Tadeusz Zaremba, all of Gliwice, Poland

[73] Assignee: Instytut Spawalnictwa, Gliwice, Poland

[21] Appl. No.: 961,034

[22] Filed: Nov. 15, 1978

[30] Foreign Application Priority Data

Nov. 30, 1977 [PL] Poland ..... 202582

[51] Int. Cl.[2] ..... H01F 21/06

[52] U.S. Cl. ..... 336/133; 336/212; 336/216

[58] Field of Search ..... 336/160, 155, 165, 212, 336/234, 133, 214, 215, 130, 216, 217, 132, 134; 219/130.1

[56] References Cited

U.S. PATENT DOCUMENTS

| | | | |
|---|---|---|---|
| 1,992,822 | 2/1935 | Granfield | 336/212 X |
| 3,319,205 | 5/1967 | Walz et al. | 336/160 X |
| 3,919,595 | 11/1975 | Willis, Jr. | 336/165 X |

FOREIGN PATENT DOCUMENTS

| | | | |
|---|---|---|---|
| 1250542 | 9/1967 | Fed. Rep. of Germany | 336/160 |
| 2654423 | 8/1978 | Fed. Rep. of Germany | 336/217 |
| 440444 | 12/1967 | Switzerland | 336/160 |

OTHER PUBLICATIONS

IBM Technical Disclosure Bulletin, vol. 21, No. 9, Feb. 1979, "Structures Connecting Main Core and Shunt Core in Controlled Transformer," Brocko et al.

*Primary Examiner*—Thomas J. Kozma

*Attorney, Agent, or Firm*—Haseltine, Lake & Waters

[57] ABSTRACT

A welding transformer with drooping voltage-current characteristic comprising a split magnetic core wound from transformer plate, and separated primary and secondary windings. In the core window, a moving shunt of the magnetic flux is provided between the secondary and primary windings. Where the magnetic flux passes from the core into the magnetic flux shunt, the core is provided with spacing blocks made from transformer plate. Laminations of these spacing blocks are so arranged in relation to the core plate that the magnetic flux does not cross the plane of the core plates but flows towards the magnetic shunt.

8 Claims, 4 Drawing Figures

WELDING TRANSFORMER WITH DROOPING VOLTAGE-CURRENT CHARACTERISTICS

FIELD OF THE INVENTION

This invention relates to a welding transformer with a magnetic core wound from cold-rolled plates, provided with a magnetic flux shunt and having a drooping voltage-current characteristic U=f(I), and designed to supply of welding arc.

PRIOR ART

Generally known welding transformers have magnetic cores assembled from shaped transformer plates, frequently cut also from cold-rolled plates.

Such method of making the magnetic cores, however, is rather labor-consuming and associated with assembling inaccuracies causing high magnetizing currents. Moreover, natural qualities of cold-rolled plates are not fully utilized, as where the leg contacts the magnetic core yoke, the flux flows crosswise with respect to the favorable direction and meets increased magnetic resistance, which causes further rise of the magnetizing current and power losses, or increased demand for the transformer plates. Because of manual assembling operations, the magnetic core cost becomes high, and there are no possibilities for implementing fully automatized production of such magnetic cores.

Also known are welding transformers with cold-rolled plate wound magnetic cores provided with flux shunts, but of very low capacity (see: ZIS Mitteilungen No 12/1977, Tragbare Schweisstransformatoren neuer Bauart by Edward DOBAJ, M.Sc. (Eng), and Wikto KOLOCZEK, Eng., Papers of Welding Institute, No. 1/77). In the wound magnetic cores, the flux—when passing into the shunt—crosses the planes of the core plates and induces eddy currents therein, thus causing excessive temperature rise in the magnetic core close to the flux shunt. Owing to this effect, wound cores are not applicable to welding transformers of medium and high capacity. As for welding transformers of low capacity, with wound tape cores, core temperature rises are admissible but some additional power loss is encountered resulting in reduced efficiency.

SUMMARY OF THE INVENTION

An object of this invention is to provide a welding transformer with a drooping voltage-current characteristic, which features low costs of production, reduced consumption of materials due to better utilization of the cold-rolled transformer plate qualities, very good suitability to welding and bettwer powe-r efficiency.

This objective has been attained in a developed welding transformer with drooping voltage-current characteristic for supply of welding current arc, consisting of a core made (most frequently) from cold-rolled plates of oriented magnetic structure, whereupon the separated primary and secondary windings are mounted. The magnetic flux moving shunt is provided in the core window, between the secondary and primary coils. Where the magnetic flux flows from the core into the shunt, the core is equipped with spacing blocks made from the transformer plates. These spacing blocks are arranged in relation to the wound tape core, so that the flux does not cross the plane of these plates but flows them over towards the magnetic shunt. It is also possible for the magnetic core to be designed with two windows, separated primary and secndary coils being mounted on this magnetic core middle leg, and two magnetic flux shunts being inserted into both the windows between the coils. The transformer plate spacing blocks with modified arrangement of laminations in relation to that of the core tape, are provided where the shunt is located in the core. Such spacing blocks can be made of powdered material (magnetic) in the form of pressed plates.

With this invention, welding transformers of any capacity can be designed, using wound tape cores from cold-rolled transformer plates.

DETAILED DESCRIPTION

Figure 1:
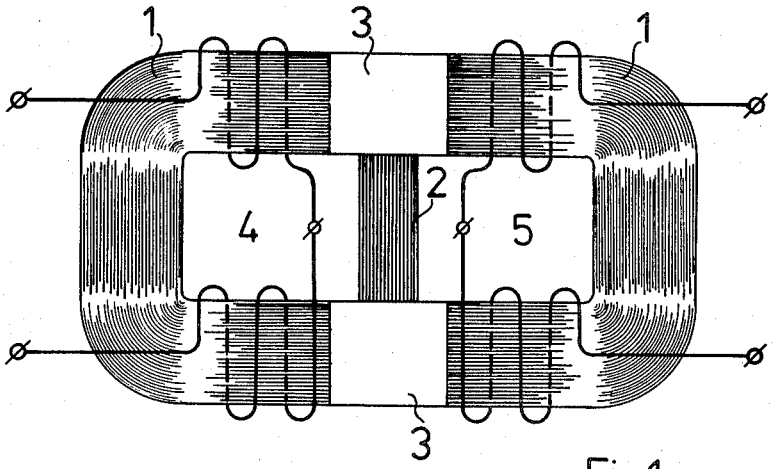
FIG. 1 is a plan view of a welding transformer according to the invention.
Figure 2:
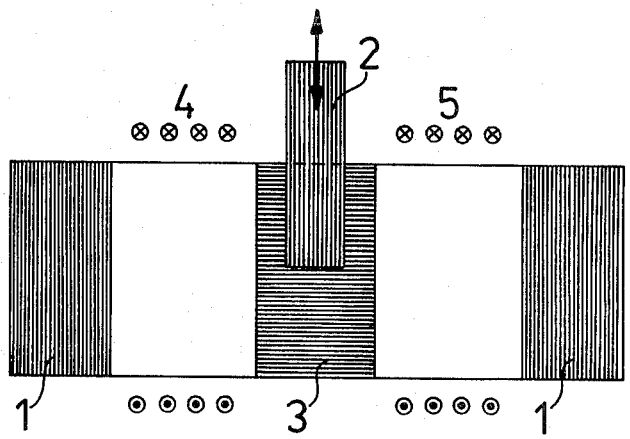
FIG. 2 is an elevational view thereof.
Figure 3:
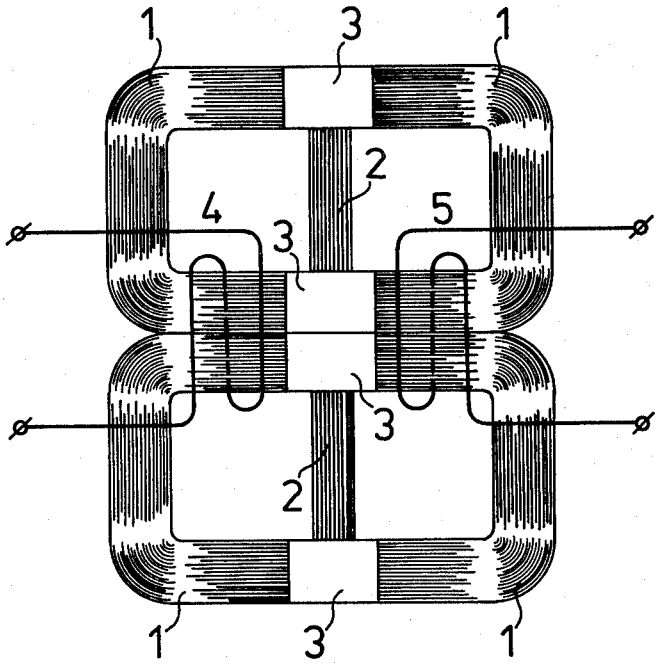
FIG. 3 is a plan view of another embodiment of a welding transformer according to the invention.
Figure 4:
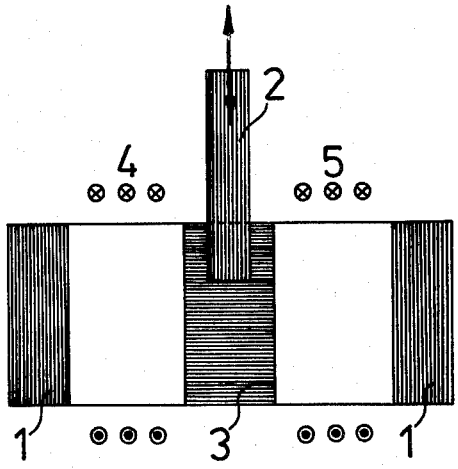
FIG. 4 is an elevational view thereof.

The welding transformer according to this invention consists of a magnetic core 1, a primary coil 4, a secondary coil 5, one or two magnetic shunts 2 (one shunt 2 being shown in FIG. 1 and two shunts in FIG. 3), and spacing blocks 3. The crossed magnetic core 1 is wound from cold-rolled plates having magnetic structure orientation. The core 1 supports the primary coil (winding) 4 and the secondary one 5, these coils being separated from coil another, and the moving magnetic shunt 2 is provided within the core window between the coils. If the magnetic core is made with two windows (FIG. 3), then two magnetic flux shunts 2 are provided. Where the magnetic flux passes crosswise from the core 1 into the shunt 2, in each leg of the core 1 will be the spacing block 3 made from transformer plate laminations preferably arranged at 90° in relation to the plane of the plates of core 1.

A drooping voltage-current characteristic is attainable for the transformer due to separation between the primary 4 and secondary 5 coils. The welding current setting will be effected by inserting the magnetic flux shunt 2 into the core 1 window between the primary coil 4 and the secondary coil 5. The magnetic flux shunt 2 contains some portion of the magnetic flux, thus reducing the coupling between the primary and secondary coils. The magnetic flux, diverting from the core 1 into the shunt 2 owing to the reversed spacing blocks 3, all the time flows along the plate section and therefore only very insignificant eddy currents, whereby the magnetic core 1 temperature near the magnetic shunt 2 does not exceed that encountered in the other parts of core 1.

What we claim is:

1. A welding transformer with drooping voltage-current characteristic adapted for supplying welding arc, comprising a magnetic core wound from transformer plate, said core having spaced legs defining a window, primary and secondary windings wound on said legs of said core in spaced relation, and a magnetic flux shunt movably inserted into said window between the primary and secondary coils, and spacing blocks in said legs at the junction of said shunt with said legs to reduce eddy currents within the magnetic core.

2. A welding transformer as claimed in claim 1 wherein said spacing blocks are incorporated into said legs.

3. A welding transformer as claimed in claim 1 wherein said spacing blocks each comprises a plurality of transformer plate laminations oriented at an angle with respect to the plates of the associated leg of the core.

4. A welding transformer as claimed in claim 3 wherein said angle is 90°.

5. A welding transformer as claimed in claim 1 wherein said transformer comprises two cores with respective windows and respective movable shunts, the primary and secondary coils being wound on juxtaposed legs of the two cores.

6. A welding transformer as claimed in claim 5 wherein said spacing blocks are incorporated into said legs.

7. A welding transformer as claimed in claim 5 wherein said spacing blocks each comprises a plurality of transformer plate laminations oriented at an angle with respect to the plates of the associated leg of the core.

8. A welding transformer as claimed in claim 7 wherein said angle is 90°.

* * * * *